US005970672A

United States Patent [19]

Robinson

[11] Patent Number: 5,970,672

[45] Date of Patent: Oct. 26, 1999

[54] BUILDING SYSTEM

[75] Inventor: Gerald Robinson, Toronto, Canada

[73] Assignee: Amisk Technologies Inc., Scarborough, Canada

[21] Appl. No.: 08/851,037

[22] Filed: May 5, 1997

[30] Foreign Application Priority Data

Dec. 16, 1996 [CA] Canada ..... 2193030

[51] Int. Cl.[6] ..... E04B 2/08; E04C 1/10

[52] U.S. Cl. ..... 52/270; 52/92.2; 52/282.2; 52/309.11; 52/584.1; 52/643; 52/800.11

[58] Field of Search ..... 52/270, 281, 282.1, 52/282.2, 241–243, 92.2, 309.4, 309.11, 584.1, 582.1, 580, 641, 643–645, 716, 771, 774, 800.11, 800.12

[56] References Cited

U.S. PATENT DOCUMENTS

| | | | |
|---|---|---|---|
| 1,170,188 | 2/1916 | Rasmussen et al. | 52/641 X |
| 2,365,579 | 12/1944 | Mulligan | 52/586.2 X |
| 2,982,055 | 5/1961 | Thompson | 52/643 X |
| 3,356,402 | 12/1967 | Smith | 52/506.7 |
| 3,406,491 | 10/1968 | Harding | 52/584.1 X |
| 3,603,049 | 9/1971 | Pierce | 52/588.1 X |
| 3,685,222 | 8/1972 | Curtess | 52/580 X |
| 3,736,708 | 6/1973 | Chapman | 52/641 X |
| 3,785,108 | 1/1974 | Satchell | 52/641 X |
| 3,950,916 | 4/1976 | Kasprzak | 52/664 X |
| 4,223,500 | 9/1980 | Clark et al. | 52/309.4 |
| 4,475,325 | 10/1984 | Veldhoen | 52/506.08 X |
| 4,503,651 | 3/1985 | Pugh | 52/639 |
| 4,635,413 | 1/1987 | Hansen et al. | 52/641 X |
| 4,646,502 | 3/1987 | Ziehbrunner | 52/580 |
| 4,678,487 | 7/1987 | Cadwell, Jr. et al. | 52/506.06 X |
| 4,754,587 | 7/1988 | Glaser | 52/309.11 X |
| 4,878,323 | 11/1989 | Nelson | 52/643 X |
| 4,965,970 | 10/1990 | Nania | 52/584.1 X |
| 5,094,059 | 3/1992 | Ganescu | 52/641 |
| 5,187,912 | 2/1993 | Hsueh | 52/584.1 X |
| 5,233,803 | 8/1993 | Bockmiller | 52/584.1 X |
| 5,566,523 | 10/1996 | Ozanne . | |

FOREIGN PATENT DOCUMENTS

| | | |
|---|---|---|
| 0180950 | 5/1986 | European Pat. Off. . |
| 671162 | 12/1929 | France . |
| 802405 | 2/1949 | Germany . |
| 3921802 | 1/1991 | Germany . |

*Primary Examiner*—Carl D. Friedman
*Assistant Examiner*—Winnie G Yip
*Attorney, Agent, or Firm*—Jane Parsons

[57] ABSTRACT

A building system and/or an erected building is based on a kit of parts including portable, prefabricated wall sections of a width of 4 feet and a height dependent on the room height desired. The sections include a metal frame having parallel members to be vertical in the erected building. These members are provided with a thermal break along their length. The thermal break may also serve as a water resistant connector between sections. Sections are aligned with abutting side edges to form walls of the building. Parallel abutting vertical members of adjacent sections form composite load bearing members for roof trusses which may be spaced apart by the width of a wall section. A hinged template for interior partitions may be provided which can be folded for transport. Ceiling panels may be connected to roof trusses through an adjustable linkage so that compensation for movement of the roof trusses is possible.

28 Claims, 13 Drawing Sheets

BUILDING SYSTEM

FIELD OF THE INVENTION

This invention relates to designs, materials, and procedures to create high-quality low-cost buildings which are quick and easy to erect. The buildings comprise manufactured components which may be assembled rapidly by unskilled labour, typically within three to five days, yielding a building that is comparable in appearance and superior in quality to a building produced by traditional building methods.

BACKGROUND OF THE INVENTION

There is a pressing world-wide need for housing. The present demand is for 250 million units. Traditional building methods will never address this need. A construction method is required that is efficient and economical, which produces housing that is acceptable and durable.

Much of this housing is required in remote areas, with extremes of climate, lack of skilled labour, and no infrastructure. Typically, this would be much of the Third World, and Indian communities in northern Canada. While these communities are cut-off by vast distances, television makes them aware of the standards of living in the rest of the world, a standard to which they aspire. Thus they will not be satisfied by an inferior product.

There is an attempt to address this market by manufactured housing. Some of the present offerings are technologically advanced but are extremely inflexible; they cannot be adapted to individual wishes. Some of these buildings also have a strange space-age appearance which is not culturally acceptable. At a lower level of technology more flexibility may be achieved, but at this level efficiency and economy are reduced, so there is little advantage over traditional construction methods.

Traditional construction methods for the provision of frame housing, whether utilizing wood or metal studs, usually involves delivery of raw building materials to the building site and subsequent building of open work frames for each wall. The open work frames are then, before or after erection, provided with cladding. Insulation is usually provided after erection either in recesses between studs and/or as foam panels applied flush onto the frame. Vapour barrier is also applied independently after erection of the frames. Electrical wiring runs to the exterior of the vapour barrier into which cuts must be made for socket access. In all the erection of a building from raw materials is a skilled job for a craftsman.

Various prefabricated buildings have been proposed. Where these are reasonably low cost they tend to be "fit-together" units such as half houses which tend to be large and require specialized transport. Often such units exceed the sizes allowed on the roads and special provisions for their transport must also be made.

The basic philosophy of this invention is to manufacture building components which are so technologically advanced they reduce to a minimum the tasks that are needed to assemble them on-site. Thus all electrical and plumbing work, all measuring and cutting, fitting and testing, are done and checked in the factory. Despite this, the system offers considerable flexibility of lay out. Components may be taken apart and reused to create new buildings of different size, form, and function.

The building has a higher insulation level (R-30) and is lighter than any other building of similar size, so the components are easy to transport. They may be assembled by an unskilled staff, with no left-over waste to dispose of.

According to the invention there is provided a building system for a building having at least one room therein, the system comprising: a plurality of prefabricated wall sections each of similar size to another to form exterior walls when aligned with a side edge of one section abutting a side edge of an adjacent section, the height of each section, when erected, generally corresponding to the height of said room, and each wall unit including a rigid peripheral metal frame and a wall panel coextensive with the frame and attached thereto; the rigid peripheral frame comprising a pair of metal frame members to each side edge of said panel member the frame members of each pair having a thermal break therebetween, the frame members, when the section is erected, being vertical, the pair of frame members of one of the wall sections being connectable to the pair of frame members of an adjacent wall section to form a composite load bearing member. Conveniently the height of each wall unit depends on ceiling height desired. Usually in Canada and the United States a standard ceiling is 8 feet. Allowing for some overlap of ceiling insulation this would entail a panel having a height of just over 8 feet, say 8 feet and three inches. If the ceiling insulation is very thick the height of the wall panel is correspondingly increased and when the room height is different, the panel height is adjusted. The panels may be four feet wide and cutout regions may be provided in at least one of the wall sections for insertion of a member of the group consisting of doors and windows.

The system may include at least one roof truss; and support means to support the roof truss between a pair of said composite load bearing members of an opposed pair of adjacent wall sections. The support means may comprise a U-shaped bracket having a web and two legs, the web being adapted to extend across the thickness of the wall unit in the region of one of the frame members and each leg of the bracket being attachable to both of the frame members forming the composite load bearing member; and each of the lugs being supportable on and attachable to the U-shaped bracket. The web of the U-shaped bracket may be provided with a pair of downwardly directed prongs to locate the bracket with respect to the frame members of one of the composite load bearing members.

The system may include at least one ceiling panel having a width similar to the width of the wall sections.

Each roof truss may be provided with a guide track along a bottom chord thereof to support edges of adjacent ceiling panels located therein. The track may be of a T-section, the vertical leg of the T lying to one side of the cross member of one of the trusses and the arms of the T projecting horizontally.

A platform may be included having a load-bearing perimeter to support the wall sections.

The system may include tracking to define a pattern for interior partitions, the tracking comprising track members being connected one to another to be hingeable between a closed position in which they lie closely together for transportation and an open position defining said pattern, the tracking being attachable to the floor platform in the open position. The tracking may include a removable spacer at predetermined doorway locations.

The system may also include interior partition units, lower edges of which are locatable in said tracking in its open position, the partition units comprising gypsum cement board panels sandwiched about a core panel of stiff foamed plastic or steel framing.

Each frame member of the wall sections may comprise a pair of elongate steel C-sections located side by side separated by a thermal break, the mouths of the C-sections opening in the same direction and accommodating parallel edge portions of a wall panel. The steel C-sections may be latched together by a snap-on elongate plastic latch also of C-section with projections to engage with the inturned flanges of the steel C-sections. Spacing ribs are provided on the plastic latch C to bias the steel C-section inturned flanges towards the inturned flanges of the plastic latch.

An elongate plastic extrusion spline member may fit into a space between the steel C-sections.

BRIEF DESCRIPTION OF THE DRAWINGS

Embodiments of the invention are described below with reference to the accompanying drawings, in which.

DETAILED DESCRIPTION OF THE INVENTION

Figure 1:
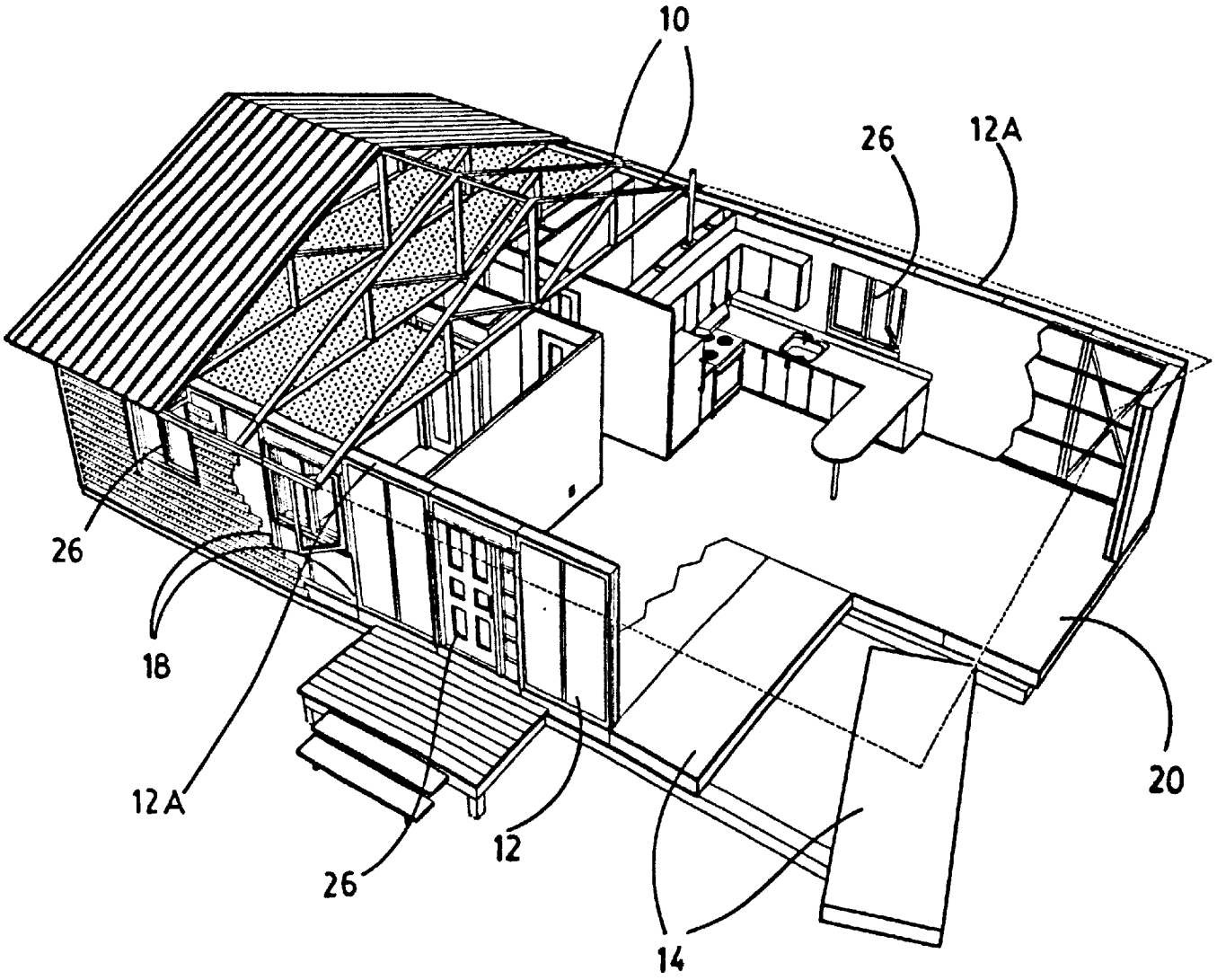
FIG. 1 is a pictorial representation of a structure according to the invention showing how roof trusses are supported by panels the structure being formed from a system according to the invention.

FIG. 1 shows a general structural lay out for a building according to the invention. Roof trusses 10 fabricated from cold-rolled steel sections sitting on wall unit 12 which rest on a floor platform 14. The wall sections 12 have a panel portion 22 and at least vertical frame units 18 formed of metal and having thermal breaks in their thickness. The spacing of the roof trusses 10 is made equal to the width of the wall panels, typically 48 inches. Roof trusses 10 have a heel member 16 at each end in the form of a downwardly depending lug. The heel 16 transfers load of the roof trusses 10 to the shoe 30 and thence to vertical frame members 18 of the wall sections 12 and thence to perimeter members 20 of the floor panels 14. This involves a spacing of structural members which is greater than the industry standard 24 inches. Although the trusses 10 should be stronger, there are half as many of them, reducing the labour required for their installation.

Figure 2:
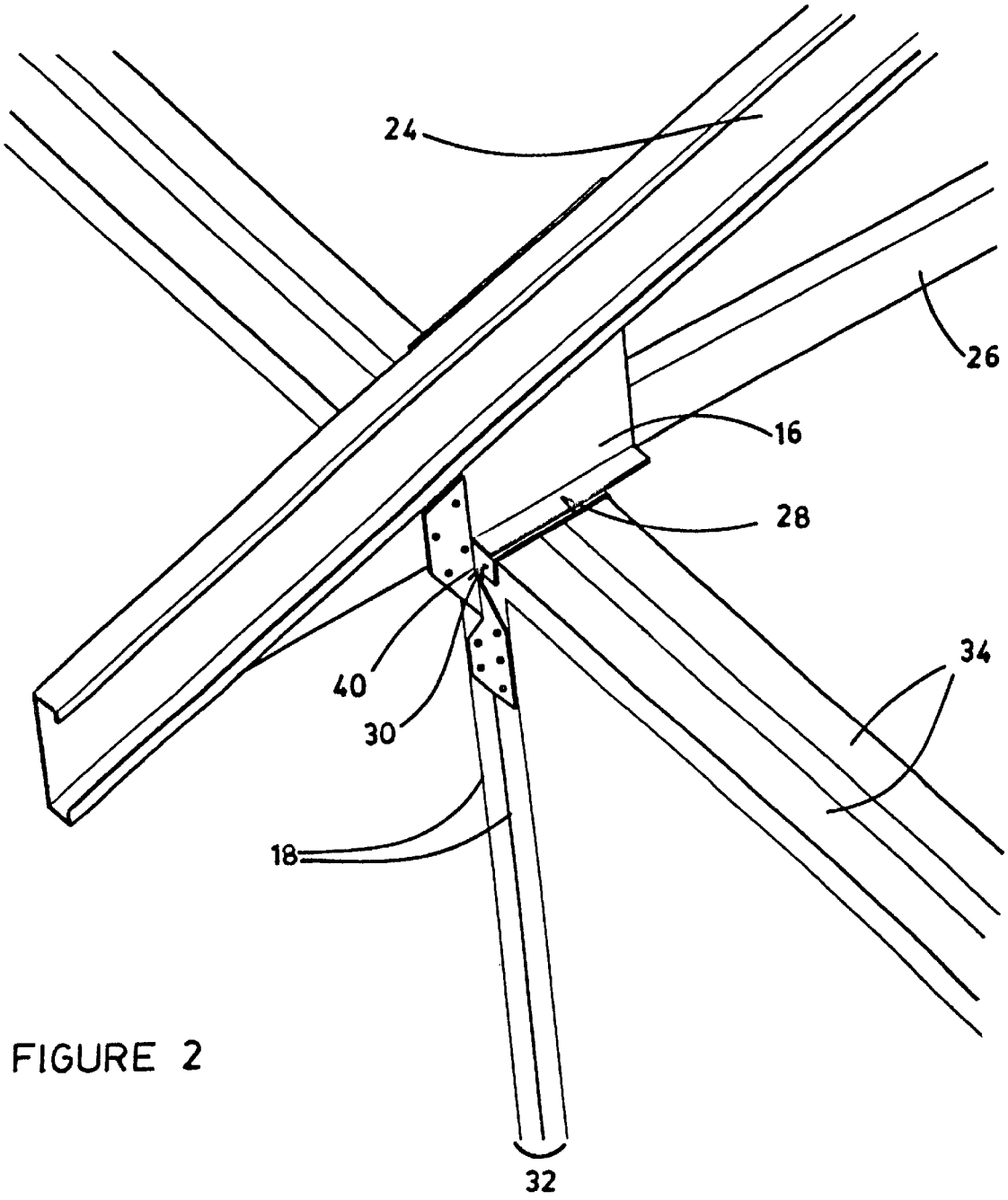
FIG. 2 is an illustration of how roof loads are transferred to the perimeter framing of panels.

By setting the trusses 10 at the same spacing as the width of the wall sections 12, vertical loads are confined to the perimeter framing members 18 of the wall panels, as shown in FIG. 2, and no loads are transferred to the body of panels. The upper chord 24 and lower chord 26 of the trusses are connected together through a heel member 16 bearing on a bent metal shoe 30 in the form of a U-bracket which laps over the wall unit 12. This shoe 30 is stiff enough to transfer loads equally to the adjacent vertical perimeter members 18 which together form a composite load-bearing member 32. No loads are transferred to upper horizontal framing members of the wall panels 34. A stamping 28 strip bent through 90° along its vertical axis attaches lower chord 26 to both framing members 18 of adjacent panels. This means that the panel requires no internal framing. Any sort of door or window or other opening can be accommodated without lintels, double-headers, or cripple studs.

Figure 3:
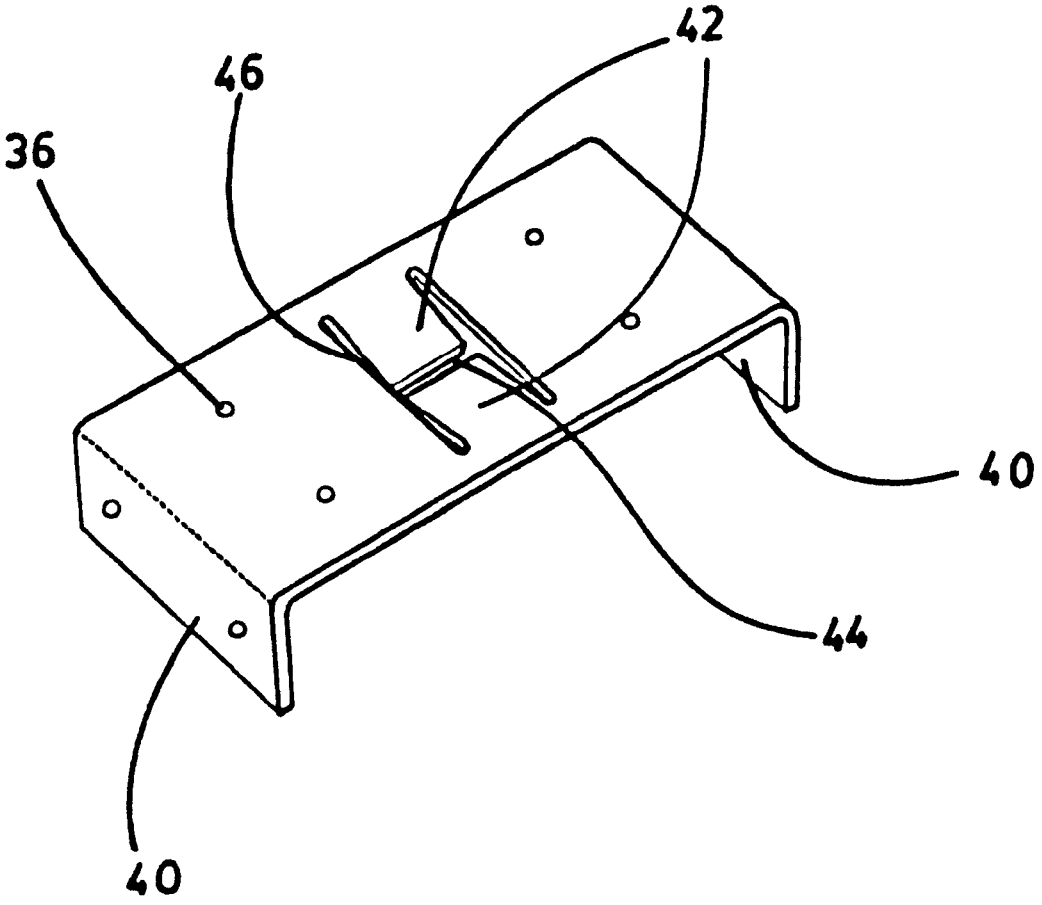
FIG. 3 is an illustration of a detail of FIG. 2.

An enlarged view of the shoe 30 is shown in FIG. 3. Holes 36 for screws are provided in the, web of shoe 30 whereby the shoe may be attached to lower chord or cross member 26 of truss 10 and to heel member 16. Two legs 40 of shoe 30 locate the truss on the wall panel longitudinally. Two tabs 42 are punched out of the central area of the shoe and project downwards as prongs. The gap between these prongs receives the central web of a wall panel connector which is aligned with the joint between panels and which will be described further hereafter. This serves to locate the truss laterally, so the combined action of the four downward projections (legs 40 and prongs 42) from the shoe 30 serves to align the truss precisely and automatically over the centre of the joint between the vertical frame members 18.

The punched opening 44 of the prongs 42 takes up most of the width of the web of the shoe 30, leaving intact two relatively narrow strips 46 which reduces the cross-sectional area available for heat transfer, helping to retain the thermal integrity of the building envelope.

Figure 4:
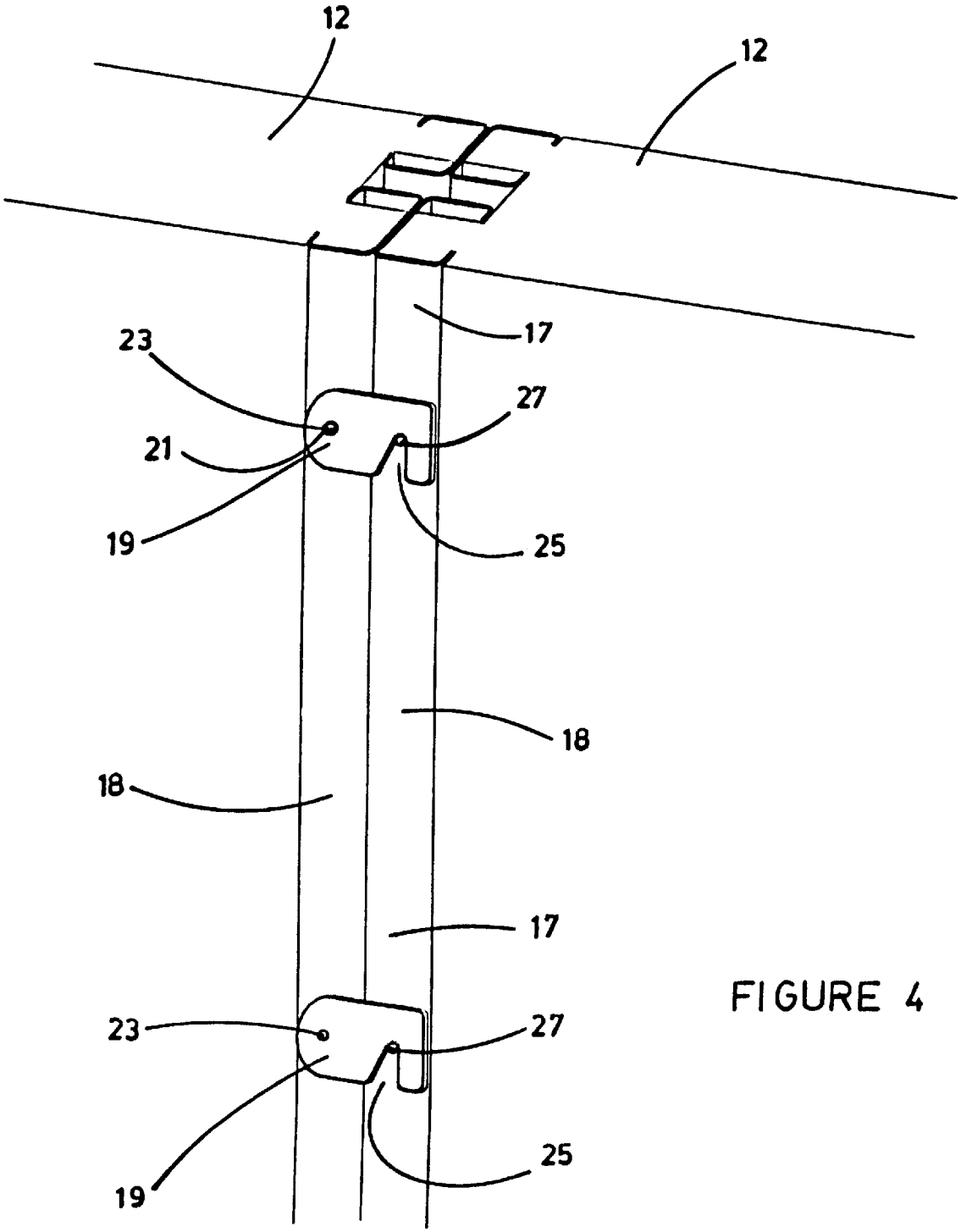
FIG. 4 shows an enlarged view of a connector/tightener member for wall sections of a building as shown in FIG. 1.

The wall sections 12 may be easily erected on either a wooden or concrete floor platform 14 simply by abutting one edge of one panel to an edge of another panel. Thermal breaks which will be described in more detail hereinafter, are provided in the thickness of the frame members 18 comprise an insulating spline 94A projecting from one edge of one panel to engage in a channel of the adjacent edge of an abutting section. These thermal breaks may, due to this engagement aid in assembly of the sections. It is, of course, important that the sections be connected together with a consistent degree of tightness so that the resultant building will be built on the square. For this purpose connector/tightener means 17 as shown in FIG. 4 are provided at intervals over the height of frame members 18 of abutting panels. Each connector/tightener member comprising a small plate 19 having an aperture 21 therethrough. A pivot pin 23 through the aperture protrudes from wall section surface of frame member 18 so that the plate 19 is pivotable to overlap the join between wall sections 12. Plate 19 has an angled slot 25 open at a downward direction. Slot 25 engages a pin 27 projecting from a wall section surface of the abutting wall section 12. The angle of the slot 25 is such that, as the plate is moved downwardly pivoting about pivot pin 23, the pin 27 is forced into closer proximity to pivot pin 73, and the wall sections 12 are tightened against each other.

The wall sections 12 may conveniently be set in metal sole plates on floor platform 14.

Figure 5:
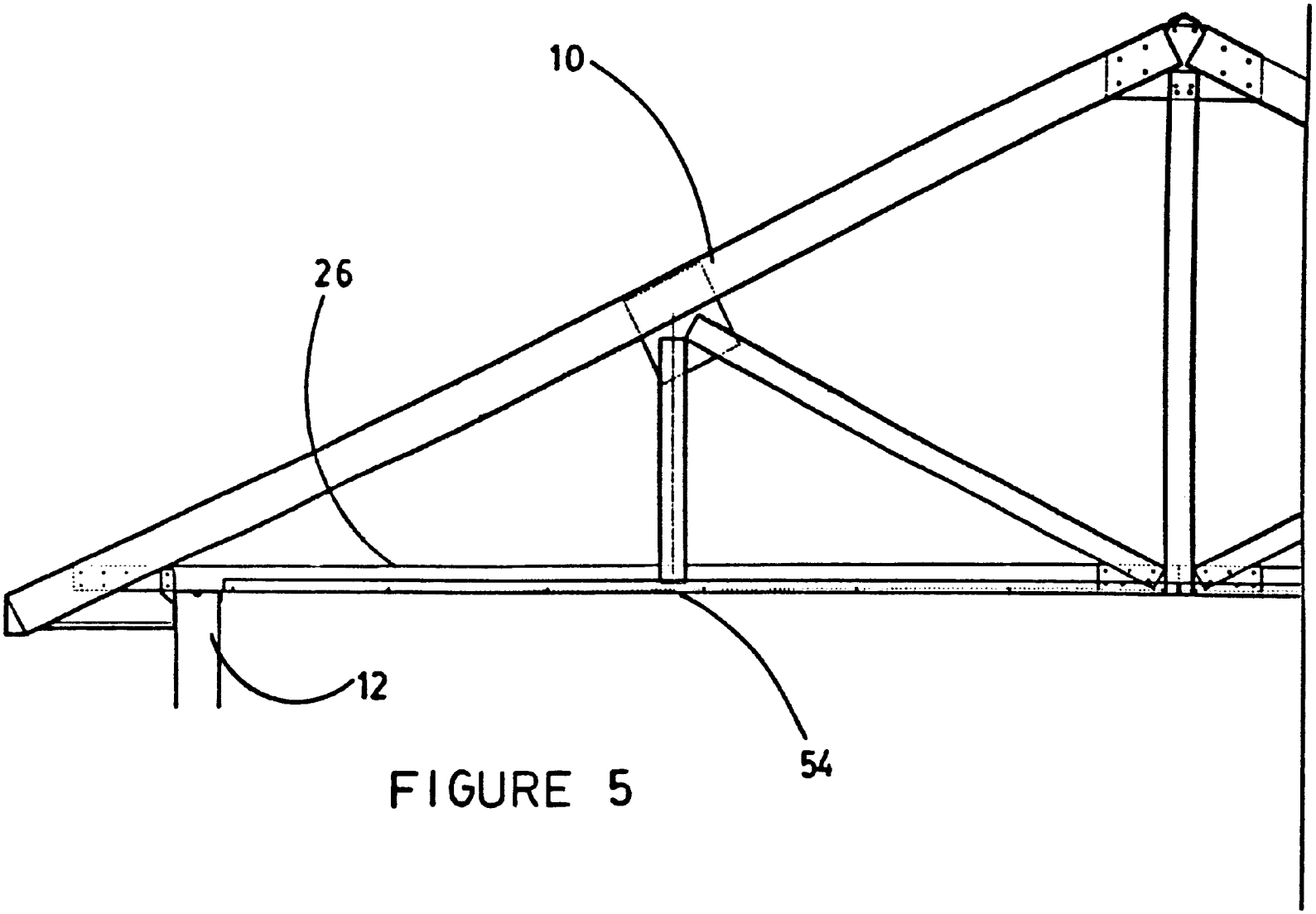
FIG. 5 illustrates a typical roof truss with a device to support ceilings without imposing a load on partitions.

As may be seen from FIGS. 4 and 5 ceilings are built up of composite panels 48 comprising a gypsum cement board 50 adhered to a foamed plastic core 52. This provides the stiffness necessary to span across the increased distance between roof trusses. The roof trusses 10 span across the entire building space from exterior wall to exterior wall. Such long spans may generate measurable deflections when the trusses 10 are loaded. The trusses 10 may be conventional trusses of either wood or metal but are preferably of metal. The trusses may in particular be as illustrated in FIG. 5 which shows part of such a truss.

Figure 6:
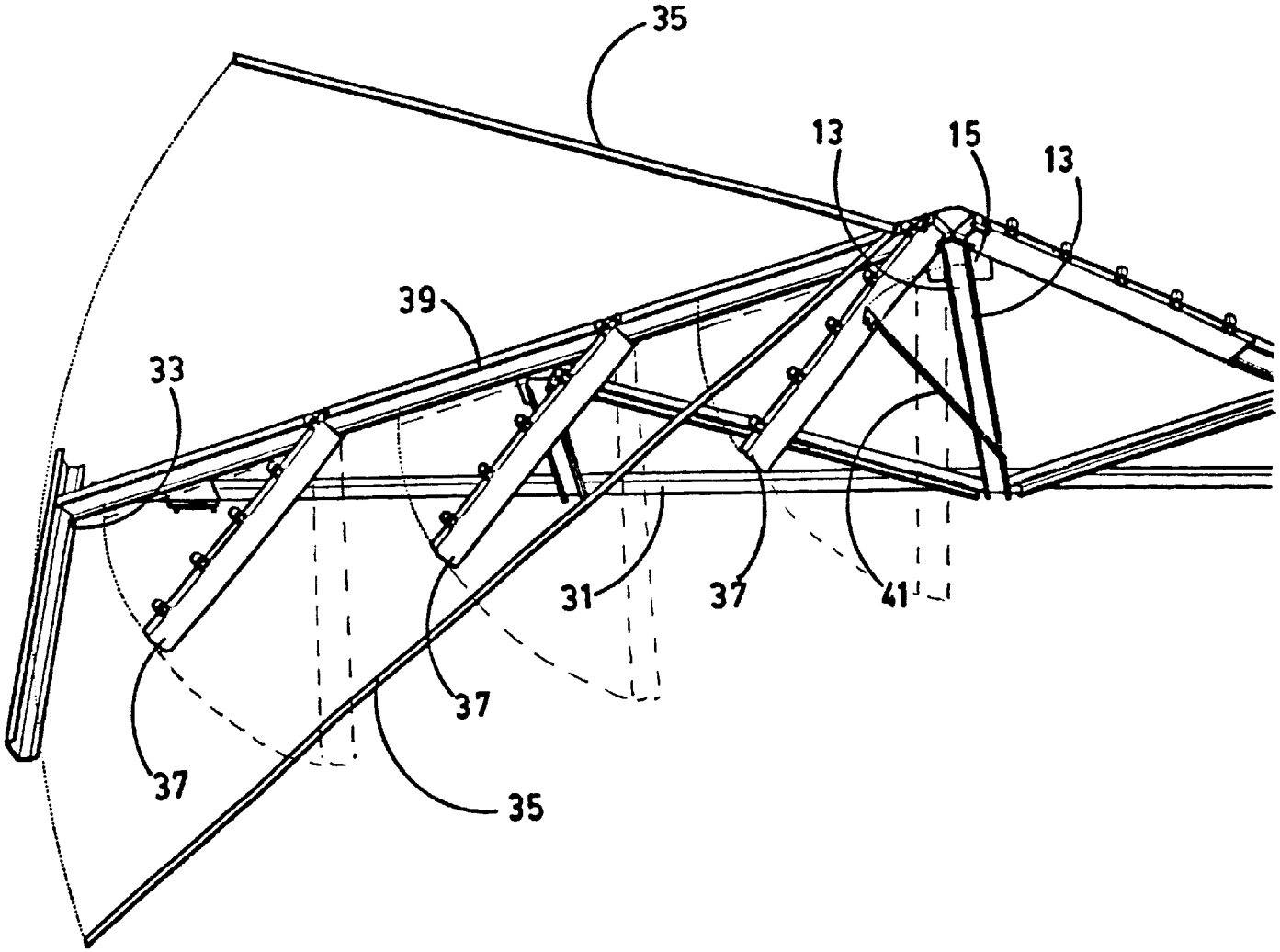
FIG. 6 is a view of an embodiment of a roof truss according to the invention.
Figure 7:
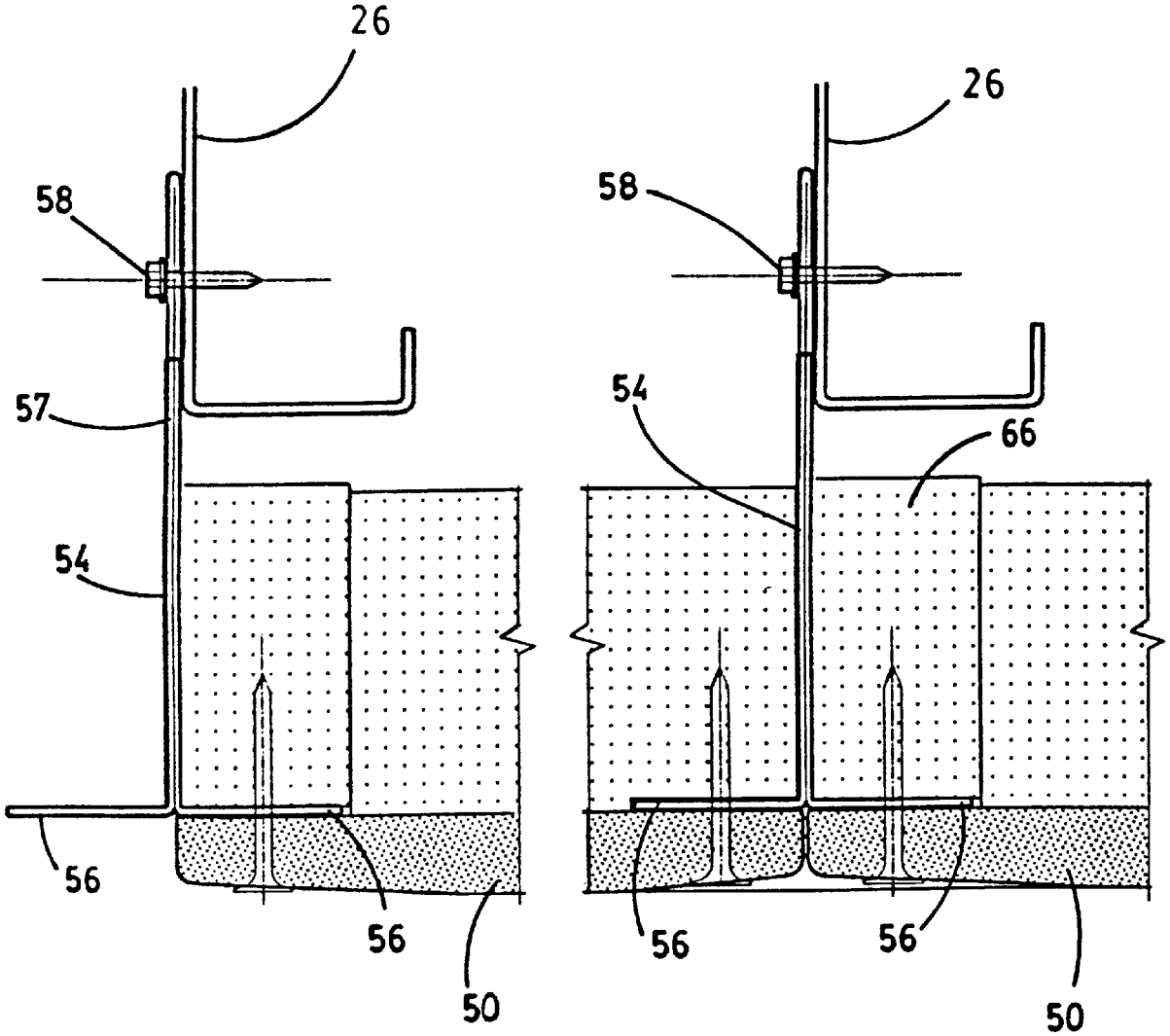
FIG. 7 is a section illustrating how composite ceiling panels are attached to the trusses.

Members needed to interconnect trusses one to another to ensure stability are attached to the trusses during manufacture, so the member of discrete pieces to be handled on the construction site is reduced to a minimum. As shown in FIG. 6, sections of purlin 37 are hinged to the top chord of the truss 39 so they may be folded in for transport and folded out to engage with the top chord of the adjacent truss during erection to ensure their correct spacing. Similarly, diagonal braces 35 are attached to the top chord of top truss 39 by pivots, so after the truss has been installed they may be deployed to attach to adjacent trusses, triangulating the orthogonal array of purlins and creating a structure of great rigidity.

Similarly, spacing member 41 may be attached to the sides of the central vertical truss member so that during erection they may be rotated to engage with the next truss to preserve the spacing of the bottom members of the trusses. Corresponding central vertical members of gable end walls have two such spacing members with separate pivots. Attaching these to the adjacent truss triangulates the gable and maintains its vertical alignment.

If the trusses 10 support a ceiling which is rigidly attached to partitions, roof loads could then be transferred to partitions which are not designed to sustain them. One way to avoid this difficulty is to provide nesting ceiling tracks which can slide within one another at the top of the partition to give the ceiling the capability of independent movement. This has the disadvantage that there is a variable gap between wall and ceiling that needs an additional trim member to cover it.

The present invention optionally provides a sliding connection between truss and ceiling, so ceiling and wall remain in fixed position with respect to each other. A T-member 54 with projecting arms 56 is attached to the bottom chord 26 of the truss 10 extending between opposing wall sections 12. The T-member 54 is attached to the bottom chord 26 by a series of screws 58 engaging in slots in the leg 57 of the T-member 56. The T-member 56 (and therefore the ceiling) is horizontal when the truss is unloaded. As the truss becomes loaded and the bottom chord 26 moves downwards the screw will slide in the slot and the ceiling supported by partitions will remain stationary, and no load will be imposed on the partitions.

Ceiling panels 50 are installed by fitting the ceiling panel onto a projecting flange 56 of the T-section 54, which then supports one edge of the ceiling panel 50. The other edge of the panel 50 is then screwed to the next T-member. Rigid insulation 66 is attached to the "upstream" side of the T-member.

Figure 8:
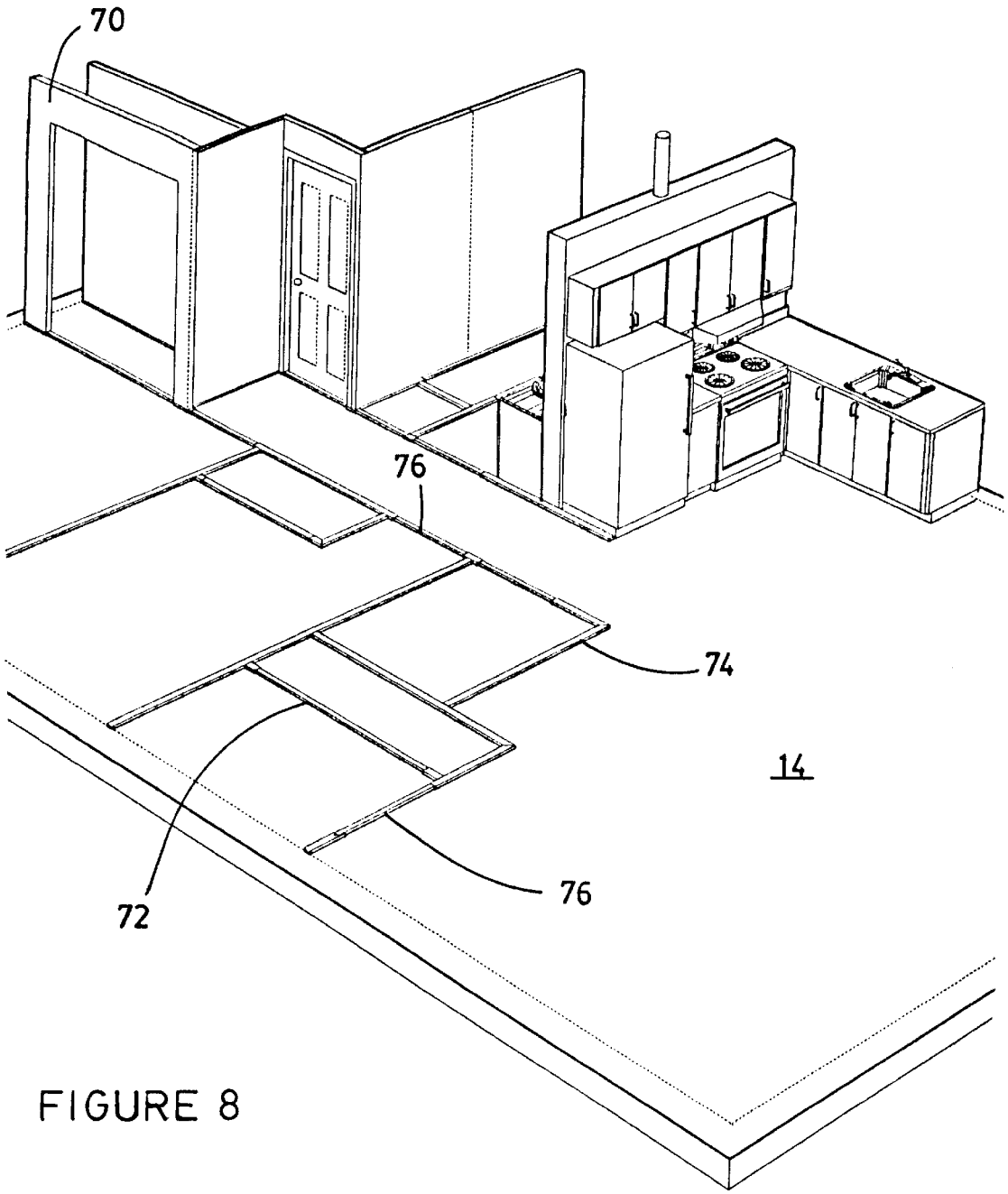
FIG. 8 shows a typical lay out for a partition floor track.

FIG. 8 shows a system according to the invention including interior partitions 70 which may be set in position positively and accurately without taking site measurements, and without marking out their positions on the floor. Interior partitions 70 are located by tracking 72 screwed to the floor 14. Each track member 74 is pre-cut in the factory for the partition it is to serve, and individual pieces of track 74 are hinged together to form the tracking 72 which locates correctly the partition intersections. The tracking 72 may be joined by slotted connections which are colour-coded to ensure their correct placement.

Figure 9:
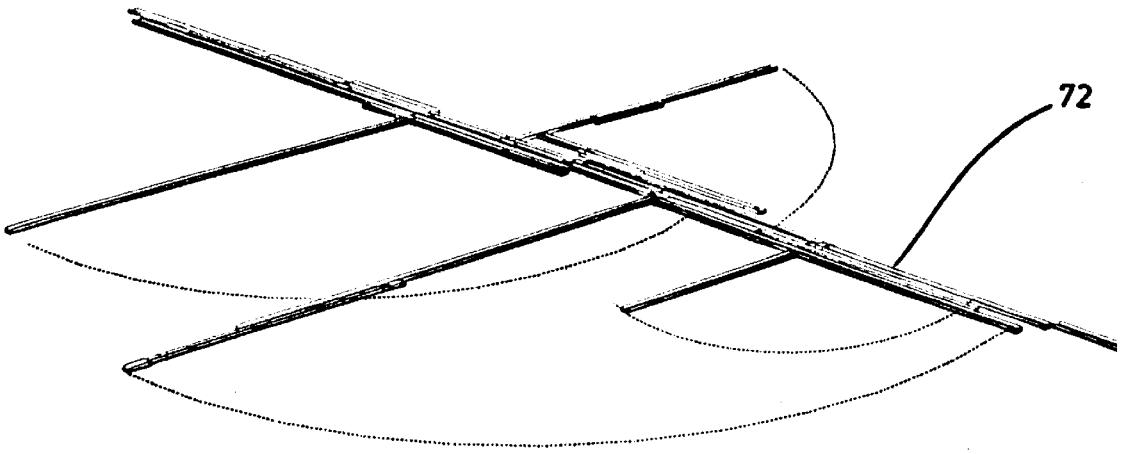
FIG. 9 shows the track of FIG. 8 partially folded and collapsed for delivery.

The hinged sub-assemblies of track may be folded into compact bundles to simplify transportation. FIG. 9 shows such a bundle of tracking 72 partially unfolded.

At door openings a disposable removable spacer 76 maintains the spacing and alignment of the track members. Coded graphic symbols along the tracking identify the panel which the tracking is to serve, and the location for electrical items such as receptacles and switches.

Figure 10:
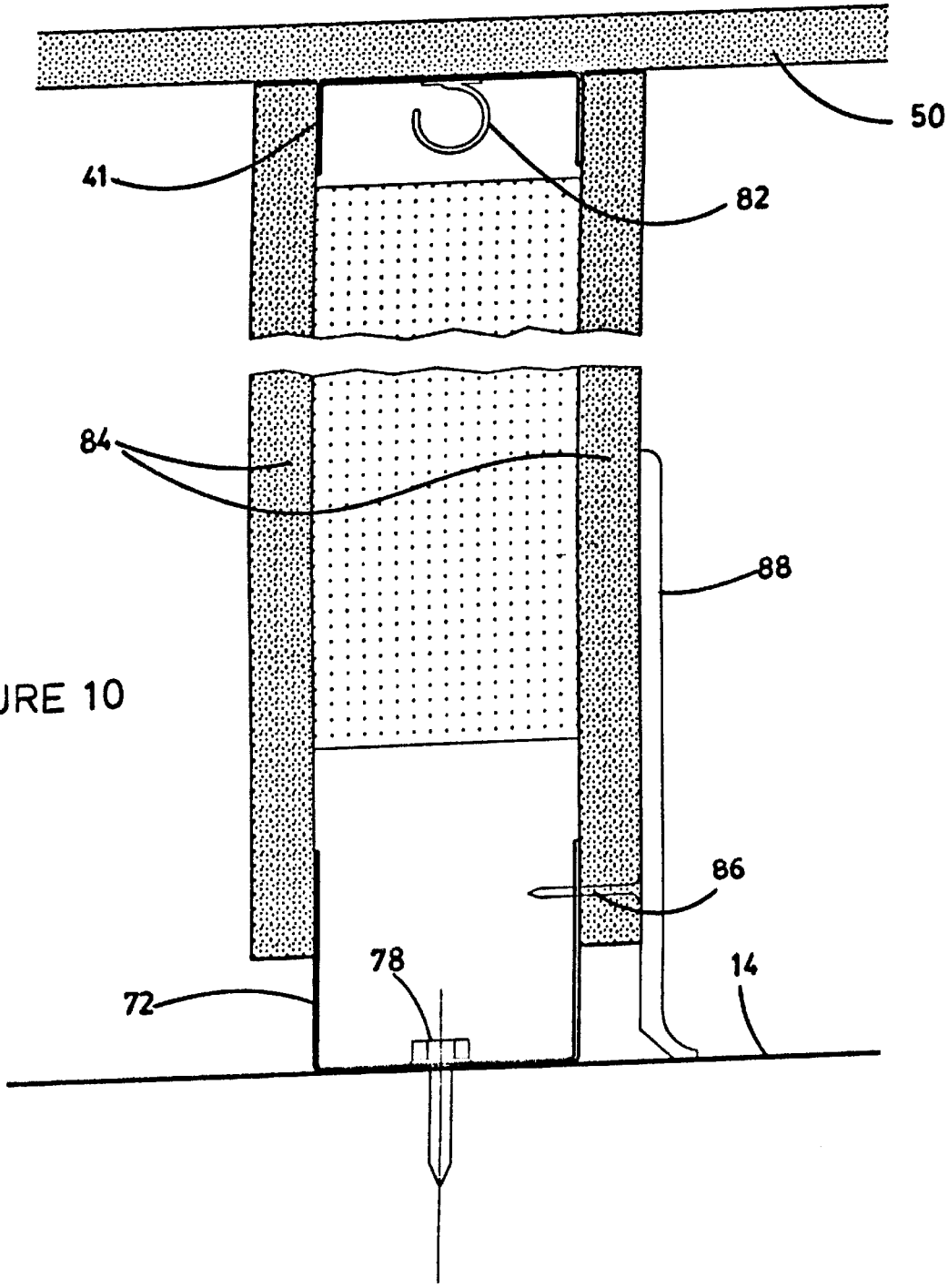
FIG. 10 is a section of a typical partition.

The installation procedure for partitions 70 is illustrated in FIG. 10. After deploying the floor track 72 on the floor 14 and screwing it in position using screws 78, the portions of a shallower, but otherwise similar, ceiling tracking 80 are screwed to the ceiling exactly above the floor tracking. A movable stud with ends fabricated to engage with the floor and ceiling tracks and a built-in level assures that these members are aligned.

The ceiling tracking has a built in electrical raceway 82, and pre-wired runs of cable with electrical boxes attached are inserted into the raceway, the boxes for switches and receptacles hanging down in their correct positions.

Partitions 70 consist of sandwich panels with facings of gypsum cement board 84 bonded to a foamed plastic core 86 or steel spacers. The core is recessed from the perimeter of the panel to provide space for track and other connectors. To erect the partition the bottom is first introduced over the floor track. The partition is then raised to a vertical position and lifted until it touches the ceiling with the legs of the ceiling tracking extending into the space formed by the core. It is screwed into place by screws 86 in this position, and the gap at the bottom is covered by the baseboard 88.

Figure 11:
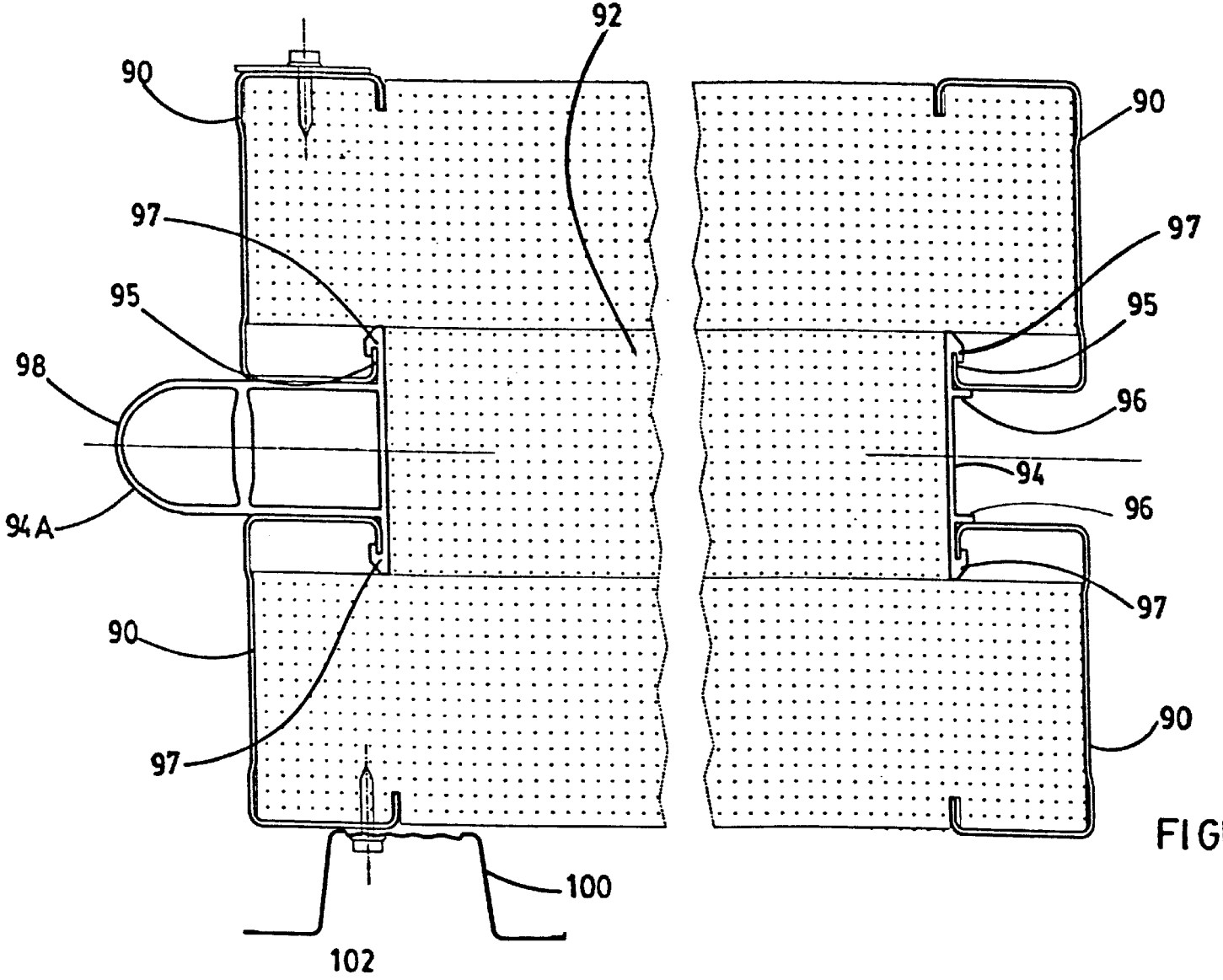
FIG. 11 shows a detail of the edges of a wall section.

FIG. 11 shows an exterior wall section 12. The vertical frame members 18 of the panels consist of pairs of cold-rolled galvanized steel C-sections 90. A panel of foamed plastic insulation 92 is located with edge portions lodged in the mouths of the C-sections. The C-sections are separated by vinyl plastic extrusions 94, 94A which provide a thermal break between the steel members on the exterior and interior of the building.

The plastic extrusion 94 comprises the form shown in FIG. 9 and is an elongate plastic C-section extrusion. The toes of which hook into adjacent toes 95 of the steel channels 90 to hold them together. The toe 95 of the steel channel 90 snaps into the hook 97 of the plastic extrusion 94 and bears against a projecting rib 96 on the extrusion which locks it into position.

The plastic extrusion 94A between the steel C-sections of adjacent panel (see FIG. 11) and the other edge of the single panel shown in FIG. 11 has a spline 98 instead of ribs 96. Spline 98 slots between steel C-sections of the frame member 18 of the adjacent wall unit to help align the panels during erection and to form a firm abutment between C-sections. The completed joint may be seen in FIG. 10 which shows a section through a composite load-bearing member 32 which itself comprises two frame members 18 each comprising 2 steel C-sections.

An arrangement of vertical steel C-sections which may be used at the corner of the building. Because wall sections 12 are to be set at right angles to each other, additional framing members, comprising steel C-sections may be set into the surface of one of the corner sections adjacent the C-sections 18. The abutting section latches between C-sections 18 and 18A of the corner section.

Figure 13:
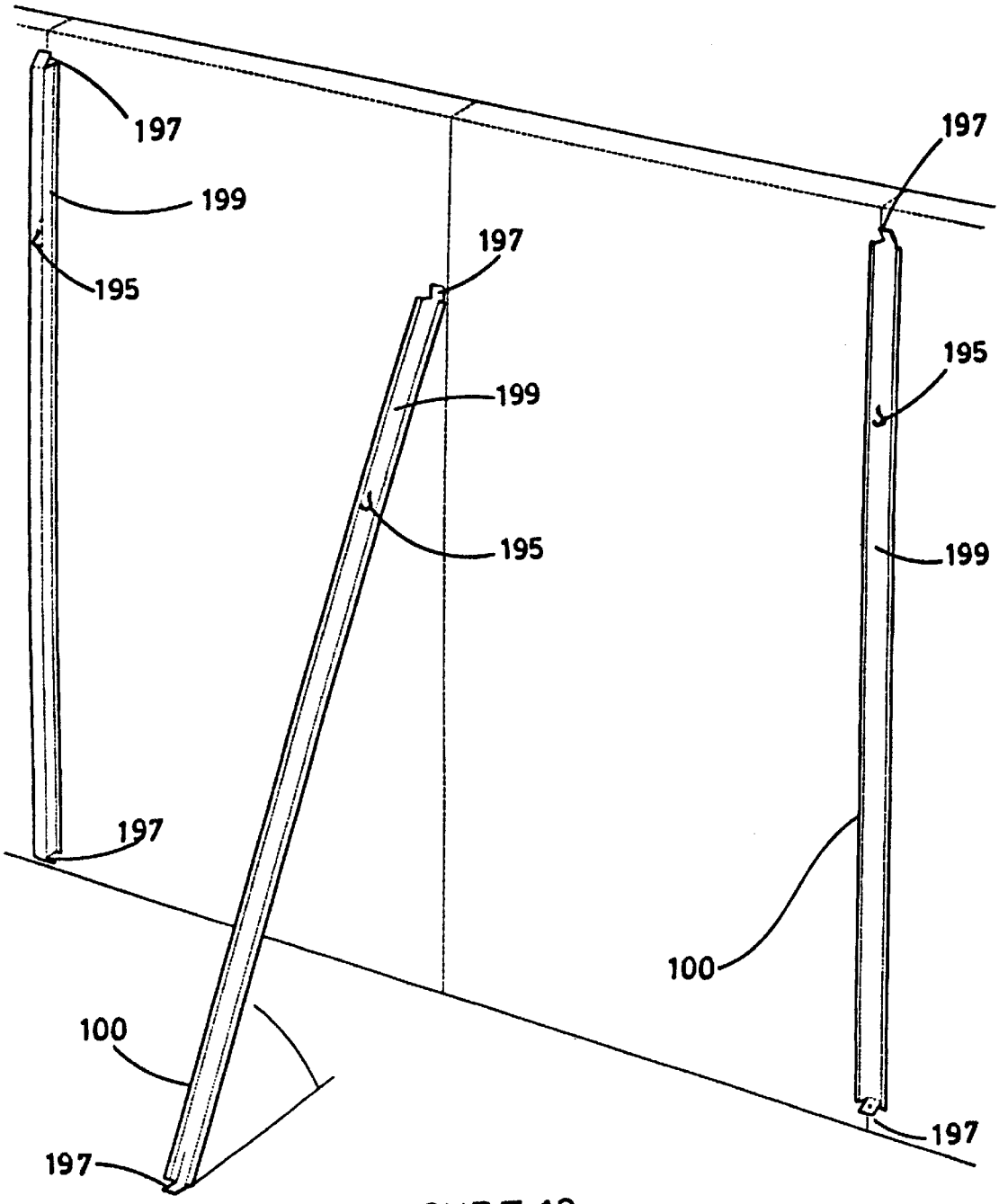
FIG. 13 shows a furring channel used as a wall brace.

Furring channels 100 having top hat section are connected to the inner face of the panel to support the interior finish. The furring channel 100 closest to the splined extrusion 94A is attached by keyhole shaped slots 195 so it is easily removable. End portions 197 of the web 199 of this furring channel extend beyond the legs. The extensions are bent inwards, 75° at the bottom and 15° at the top, and are pre-drilled for screws, so the removed channel may be re-screwed to the panel and screwed to the floor at an angle of approximately 75°. This attachment of the furring channel forms a brace which preserves the verticality of the walls while roof trusses are being erected, and during strong winds, when the roof system is installed and braced, the furring channels are detached and re-installed on the wall panels to provide support for the interior finishes. Thus the furring channels may do double duty as vertical braces while the structure is being erected. Furring channels may also be provided on the inner face of the unit 12 for additional support of the drywall. These furring channels may be located with the web flush with the inner face of unit 12 or spaced from it (see FIG. 13).

The conjunction between two wall sections 12 is shown in FIG. 10. Here the spline is shown inserted into the groove between steel C-sections of the adjacent unit, and the leading furring channel 100 is shown in its advanced position with the interior finish 104 attached. The rotary clip 102 has now advanced to overlap the frame member 18 of the next unit 12, and by screwing it to this frame member 18 the two units 12 are connected. A similar rotary clip connects the outer faces of the panel frames.

Figure 12:
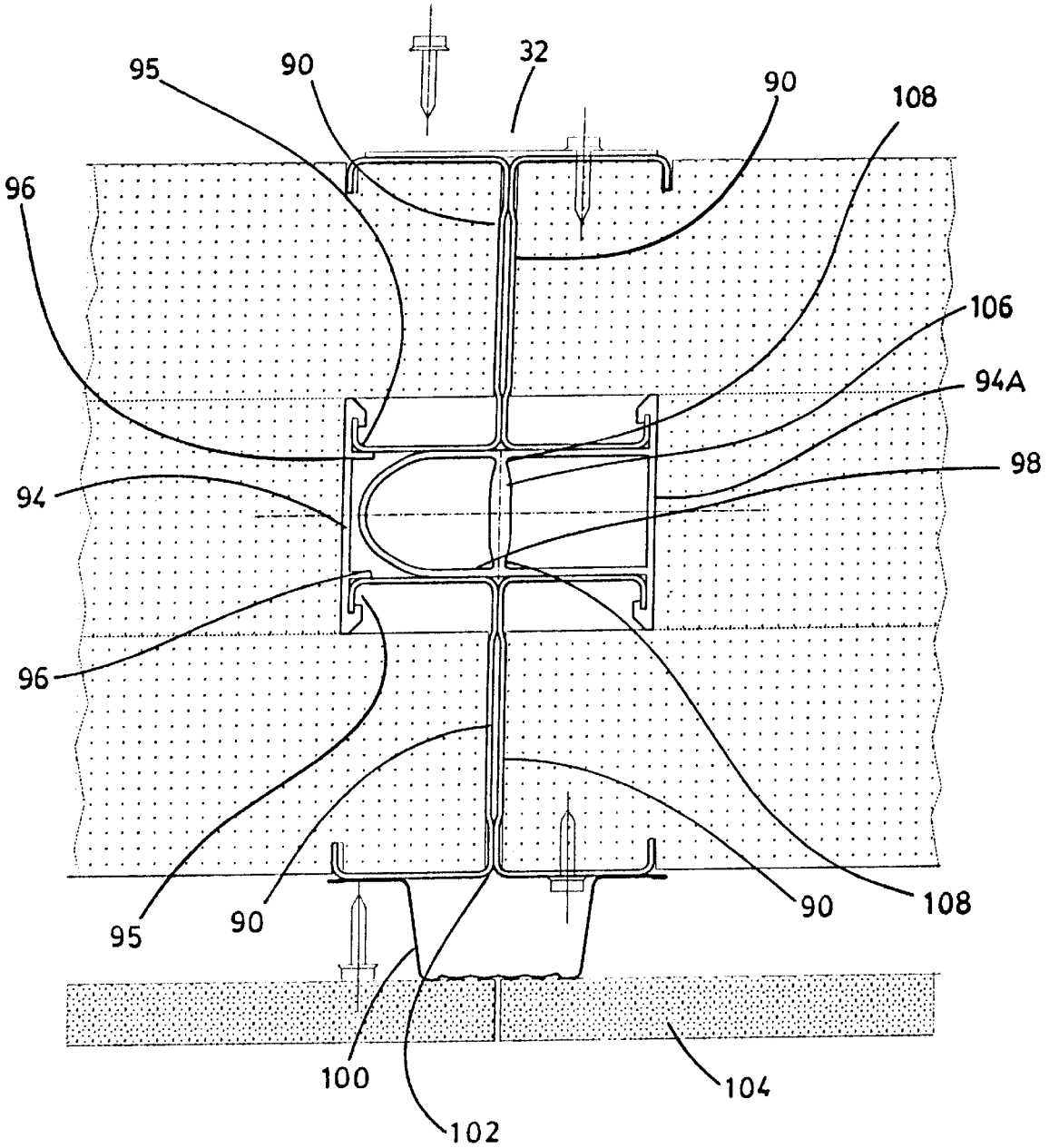
FIG. 12 shows the joining of one wall panel to another.

The plastic extrusion 94A is illustrated in an enlarged view in FIG. 12. It has a web 106 across the projecting portion which is aligned with the centre line of the joint between units. This will transfer lateral loads from between the inner and outer steel framing members. The web acts as a short column, so it is thickened in the centre to resist buckling due to compressive loads. At the ends 108 of the web 106 the thickness is reduced symmetrically. This directs lateral forces through the centre of the web, and reduces bending of the web due to eccentric loading.

The body of the extrusion 94A is dimensioned to be a sliding fit between the flanges of the steel channels that encase it. Nearer the end, the width of the spline is increased to create an interference fit between the steel channels of the next panel. This pressure causes the central part of the sides of the projection to rotate, the narrowed portion of the web acting as a hinge. The rotation causes the sides of the root of the projection to press against the flanges of the channels framing the first panel, creating an air-tight seal between panels, and between the interior and the exterior of the building.

The combination of plastic extrusion and steel channels thus combines in one unit the functions of a thermal break, a vapour barrier, an air barrier, a connector for steel framing members, a load transfer device, and a locating spline for aligning panels during erection.

I claim:

1. A kit of parts for a building, the kit comprising:

a plurality of portable prefabricated wall sections each of similar size to another and having opposed parallel sides to form exterior perimeter walls for the building when the sections are abutted with a side of one section abutting a side of an adjacent section, the height of each section, when erected, generally corresponding to the height of the perimeter walls, and each wall section including a rigid peripheral metal frame and a wall panel comprising a slab of foam plastics material having opposed faces, the slab being coextensive with the frame and attached to said frame;

the rigid peripheral frame comprising two opposed parallel frame sides, each of said frame sides located as one of said sides of the wall section, each frame side comprising:

a pair of spaced apart elongate metal C-sections within the thickness of the wall section, each C-section comprising a web and two legs, one leg of each C-section of said pair being located at each face of said slab, mouths of the metal C-sections of said pair opening in the same direction directed inwardly of the frame and accommodating parallel edge portions of said slab, the metal C-sections, when the section is erected, being vertical;

connection means to connect the pair of C-sections at one side of one wall section to the pair of metal C-sections of an abutting side of an abutting wall section to form a composite load bearing member;

each pair of metal C-sections being latched together and spaced apart by an elongate plastic C-section latch, inturned flanges of the metal C-sections and the plastic C-section latch being interengageable, elongate spacing ribs being provided on the plastic C-section latch to bias the metal C-sections apart, and a thermal break being formed by said plastic C-section latches and disposed in the space between said metal C-sections of two abutting walls sections.

2. A kit of parts as claimed in claim 1 in which each wall section is four feet wide.

3. A kit of parts as claimed in claim 2 in which the metal is steel.

4. A kit of parts as claimed in claim 1 in which the spacing ribs of one of the plastic latches between metal C-sections at one side of the slab are short to leave an open channel between the metal C-sections, and the spacing ribs of the other of the plastic latches between metal C-sections at the other side of the slab are extended as a spline outwardly of the metal C-sections at said other side edge and to project into the channel between C-sections of an abutting wall section.

5. A kit of parts as claimed in claim 4 in which the spline is hollow and is provided with a reinforcing rib to be located generally on a line of abutment between wall sections.

6. A kit of parts as claimed in claim 5 in which the spline, when uncompressed, has a bulge in its thickness to form a firm water resistant seal between wall sections.

7. A kit of parts as claimed in claim 1 in which the connection means includes means for progressively tightening the wall sections together.

8. A kit of parts as claimed in claim 7 in which the means for progressively tightening wall sections together comprises a plate hinged to at least one surface of a frame member to pivot in a plane flush with said one surface, the plate having a slot open at one end to engage a projection on an abutting wall section, the slot being angled to draw the wall sections together when the plate is pivoted in one direction with the projection engaged in the slot.

9. A kit of parts as claimed in claim 1 in which a cutout region is provided in at least one of the wall sections for insertion of a member of the group consisting of doors and windows.

10. A kit of parts as claimed in claim 1 including at least one roof truss; and support means to support the roof truss between composite load bearing members formed between abutting wall sections of an opposed pair of said perimeter walls.

11. A kit of parts as claimed in claim 10 including a plurality of ceiling panels to be supported between adjacent roof trusses, each of the ceiling panels having a width similar to the width of the wall sections.

12. A kit of parts as claimed in claim 11 including a floor platform.

13. A kit of parts as claimed in claim 12 in which a tracking is provided to define a pattern for interior partitions, the tracking comprising track members being connected one to another to be hingeable between a folded position in which they lie closely together and an unfolded position defining said pattern, the tracking being attachable to the floor platform in the unfolded position.

14. A kit of parts as claimed in claim 13 in which the tracking includes removable spacers at predetermined doorway locations.

15. A kit of parts as claimed in claim 14 including interior partition units, lower edges of which are locatable in said track members with the tracking in its unfolded position, the partition units comprising gypsum cement board panels sandwiched about a core panel of stiff foamed plastic or metal frame members.

16. A building comprising:

a plurality of portable prefabricated wall sections each of similar size to another and having opposed parallel sides forming exterior perimeter walls of the building, the sections being abutted with a side of one section abutting a side of an adjacent section, the height of each section generally corresponding to the height of the perimeter walls, and each wall section including a rigid peripheral metal frame and a wall panel comprising a slab of foam plastic material coextensive with the frame and attached thereto;

the rigid peripheral frame comprising two opposed parallel frame sides, each of said frame sides located as one of said sides of the wall section, each frame side comprising:

a pair of spaced apart elongate metal C-sections, one pair located to each side of said slab, the mouths of the metal C-sections opening in the same direction directed inwardly of the frame and accommodating parallel edge portions of said slab;

connection means connecting the pair of C-sections at one side of one wall section to the pair of metal C-sections at an abutting side of an abutting wall section forming a composite load bearing member;

each pair of metal C-sections being latched together and spaced apart by an elongate plastic C-section latch, inturned flanges of the metal C-section and the plastic C-section latch being interengagable, elongate spacing-ribs being provided on the plastic C-section latch to bias the metal C-sections apart, and a thermal break being formed by said plastic C-section latches and disposed in the space between said metal C-sections of two abutting walls sections.

17. A building as claimed in claim 16 in which each wall section is four feet wide.

18. A building as claimed in claim 17 in which the metal is steel.

19. A building as claimed in claim 16 in which the metal C-sections of the spacing ribs of one of the plastic latches between metal C-sections at one side of the slab are short to leave an open channel between the metal C-sections and the spacing ribs of the other of the plastic latches between metal C-sections at the other side of the slab are extended as a spline outwardly of the metal C-sections at said other side and to project into the channel between C-sections of an abutting wall section.

20. A building as claimed in claim 19 in which the spline is hollow and is provided with a reinforcing rib to be located generally on a line of abutment between wall sections.

21. A building as claimed in claim 20 in which the spline, when uncompressed, has a bulge in its thickness to form a firm water resistant seal between wall sections.

22. A building as claimed in claim 21, in which the connection means include means for progressively tightening the wall sections together comprising a plate hinged to at least one surface of a frame member to pivot in a plane flush with said one surface, the plate having a slot open at one end to engage a projection on an adjacent wall section, the slot being angled to draw the wall sections together when the plate is pivoted in one direction with the projection engaged in the slot.

23. A building as claimed in claim 16 including at least one roof truss supported by support means between composite load bearing members formed between abutting wall sections of an opposed pair of said perimeter walls.

24. A building as claimed in claim 23 including a plurality of ceiling panels being supported between adjacent roof trusses, each of the ceiling panels having a width similar to the width of the wall sections.

25. A building as claimed in claim 16 including a floor platform, said portable prefabricated wall sections of the building being supported on a perimeter of said floor platform.

26. A building as claimed in claim 25 in which a tracking is provided to define a pattern for interior partitions, the tracking comprising track members being connected one to another to be hingeable between a folded position in which they lie closely together and an unfolded position defining said pattern, the tracking being attachable to the floor platform in the unfolded position.

27. A building as claimed in claim 26 in which the tracking includes a removable spacer at predetermined doorway locations.

28. A building as claimed in claim 26 including interior partition units, lower edges of which are locatable in said track members with the tracking in its open position, the partition units comprising gypsum cement board panels sandwiched about a core panel of stiff foamed plastic or metal spacers.

* * * * *